US006658806B1

(12) United States Patent
Leek

(10) Patent No.: US 6,658,806 B1
(45) Date of Patent: Dec. 9, 2003

(54) SUPPORT FOR A STRAP HOLDOWN

(75) Inventor: William F. Leek, Carmel, CA (US)

(73) Assignee: Simpson Strong-Tie Company, Inc., Dublin, CA (US)

( * ) Notice: Subject to any disclaimer, the term of this patent is extended or adjusted under 35 U.S.C. 154(b) by 0 days.

(21) Appl. No.: 09/620,782

(22) Filed: Jul. 21, 2000

(51) Int. Cl.[7] ..... E02D 27/32

(52) U.S. Cl. ..... 52/295; 52/370; 52/699; 52/714; 52/715; 248/220.31; 248/221.12; 248/222.41; 248/225.11

(58) Field of Search ..... 52/264, 293–296, 52/712–715, 699, 370; 403/174, 176, 246, 230, 252, 408.1, 245, 353; 411/480, 482, 455, 922; 248/221.12, 220.21, 220.31, 222.41, 225.11

(56) References Cited

U.S. PATENT DOCUMENTS

| | | | | | |
|---|---|---|---|---|---|
| 1,873,731 | A | | 8/1932 | Zingali | |
| 3,998,026 | A | * | 12/1976 | Allen | 52/714 |
| 4,202,149 | A | | 5/1980 | Betrue | |
| 4,344,604 | A | | 8/1982 | Basey | |
| 4,404,781 | A | * | 9/1983 | Gilb | 52/295 |
| 4,413,456 | A | * | 11/1983 | Gilb | 52/295 |
| 4,570,403 | A | * | 2/1986 | Dannemiller | 52/295 |
| 4,587,788 | A | | 5/1986 | Bielicki | |
| 4,739,598 | A | | 4/1988 | Jensen | |
| 4,846,615 | A | | 7/1989 | Forsyth | |
| 4,932,105 | A | * | 6/1990 | Muller | 24/666 |
| 4,943,023 | A | | 7/1990 | Becker | |
| 5,048,999 | A | | 9/1991 | Wurl | |
| 5,150,553 | A | * | 9/1992 | Commins et al. | 52/264 |
| 5,295,754 | A | | 3/1994 | Kato | |
| 5,390,455 | A | | 2/1995 | Antolini | |
| 5,407,182 | A | | 4/1995 | Hartley | |
| 5,595,031 | A | * | 1/1997 | Commins | 52/264 |
| 5,670,076 | A | | 9/1997 | Leek | |
| 5,813,182 | A | * | 9/1998 | Commins | 52/295 |
| 6,062,789 | A | * | 5/2000 | Pope | 411/482 |

OTHER PUBLICATIONS

Advanced Connector Systems, "AFS From Shoe," AFS From Shoe Pamphlet, Advanced Connector Systems (Phoenix, Arizona), p. 1–3, (1996).

Symons Corporation, "Concrete Forming System," Concrete Forming System Brochure, Symons Corporation (Des Plaines, Illinois), p. 1–24, (1994).

Simpson Strong–Tie Company, Inc., "PAHD/MPAHD/HPAHD Holdowns," Catalog C–95H–1, Simpson Strong–Tie Company, Inc. (Pleasanton, California), p. 18–19, (1994).

(List continued on next page.)

*Primary Examiner*—Carl D. Friedman
*Assistant Examiner*—Yvonne M. Horton
(74) *Attorney, Agent, or Firm*—James R. Cypher; Charles R. Cypher

(57) ABSTRACT

A connector that is to be partially embedded in a cementitious member is adapted to make a more positive connection to a form board for the cementitious member. The embedded portion of the connector is formed with a opening that can receive and hold the shank of a nail that is partially driven into a form board. Preferably, a double-headed nail is held by a keyhole-shaped opening. The double-headed nail is held by the narrow portion of the keyhole slot at the upper portion of the shank between the end most head and the intermediate flanges or head of the nail. The nail is moved into position by inserting the nail through the wide portion of the keyhole opening so that the intermediate head and the upper portion of the shank is received thereby. Then, the upper portion of the shank of the fastener is slid out of the wide portion and into the narrow portion of the keyhole opening to finish the connection.

17 Claims, 7 Drawing Sheets

OTHER PUBLICATIONS

Simpson Strong–Tie Company, Inc., "MASB/MAS/MAB/MA Mudsill Anchors," Catalog C–98, Simpson Strong–Tie Company, Inc. (Pleasanton, California), p. 9, (1997).

Simpson Strong–Tie Company, Inc., "MKP Monkey Paw Anchor Bolt Holders," Catalog C–98, Simpson Strong–Tie Company, Inc. (Pleasanton, California), p. 21, (1997).

Bulldog–Simpson GmbH, 'Statische Berechnungen Simpson—HRB—Verbinder Bulldog–Simpson GmbH (Germany), p. 1–3, ( Nov. 1998).

* cited by examiner

SUPPORT FOR A STRAP HOLDOWN

BACKGROUND

This invention relates to an elongate connector for securing a vertically disposed structural member to a concrete foundation. The connector is partially embedded in a concrete foundation and fasteners attach the connector to the structural member to be anchored. According to the present invention, the embedded portion of the connector is formed with a keyhole opening or slot that, in the preferred embodiment, can receive the intermediate head and hold the shank of a standard double-headed nail. The slot is located in the embedded portion of the connector such that the tip of the nail can be partially driven into a wooden form board or other member. A form board, as used here, is a member used to define the boundaries of a poured concrete foundation or other cementitious member. By connecting the double-headed nail to the connector and to the form board the nail serves as a brace for the connector. This helps to keep the connector plumb, during the pouring of the concrete.

As is evidenced by such previous patents as U.S. Pat. No. 5,150,553, granted to Alfred D. Commins on Sep. 29, 1992, and U.S. Pat. No. 5,813,182, also granted to Alfred D. Commins on Sep. 29, 1998, connectors that are partially embedded in a concrete foundation and are attached to a vertically disposed structural member by means of fasteners are well known in the prior art. U.S. Pat. Nos. 5,150,553 and 5,813,182 are incorporated herein by reference. These connectors, commonly called strap anchors, have been widely accepted by builders due to the ease with which they can be installed, and their relatively low cost in comparison to other types of anchors.

Strap anchors, as described above, are generally elongate members. They protrude above the upper level of the foundation considerably. Strap anchors are generally designed to be attached with light fasteners such as nails. A large number of nails are generally needed to make a secure attachment between the connector and the structural member. Thus the upper portion of the connector must be rather long to accommodate the larger number of fasteners.

The fact that a considerable portion of a strap anchor protrudes above the level of the foundation raises problems during the pouring of the cement around the strap anchor. Generally, strap anchors are attached to the outer form boards near the tops of the form boards by means of typical fasteners such as nails. The inventor has found that during a typical foundation pour, the flowing concrete has a tendency to move the strap anchor out of the alignment it originally had when it was attached to the form board. This is thought to occur because the attachment of the strap anchor to the form board is insufficient.

To improve the connection between the form board and the strap anchor so that the anchor is less likely to be moved out of its original alignment, the inventor has devised an additional attachment between the form board and the strap anchor.

SUMMARY OF THE PRESENT INVENTION

It is an object of the present invention to provide an improved connection and a method of making that connection between a connector and the form from which it is suspended, so that the connector remains in alignment during the pouring of a cementitious member.

The improved connection is achieved by making an additional attachment between the connector and the form.

The additional attachment is made possible because the embedded portion of the connector is formed with a opening that can receive and hold the shank of a nail that is partially driven into a form board.

In one form of the invention the additional attachment is made with a double-headed nail. Preferably, the embedded portion of the connector holds the upper portion of the shank of the double-headed nail between the end most head and the intermediate flanges or head of the nail.

In another form of the invention, the nail is held by a narrow or constricted portion of a specially shaped opening, having both an enlarged portion and a constricted portion. This shaped opening can be keyhole-shaped. The constricted portion of the opening is shaped so that the side of the opening lies closely adjacent to the shank of the fastener near at least two points on the shank of the fastener. The constricted portion of the opening can be shaped with two substantially opposed side edges spaced just enough from each other to receive the shank of the nail. The enlarged portion of the opening can be circular in shape to closely receive the head of a fastener.

To make the connection the nail is moved into position by inserting the nail through the wide portion of the opening such that the shank is received thereby. The nail is driven partially into the form board. Then the shank of the fastener is slid out of the wide portion and into the narrow portion of the keyhole opening. The form board is preferably the same form board to which the strap anchor is already attached.

DESCRIPTION OF THE PREFERRED EMBODIMENT OF THE INVENTION

Figure 1A:
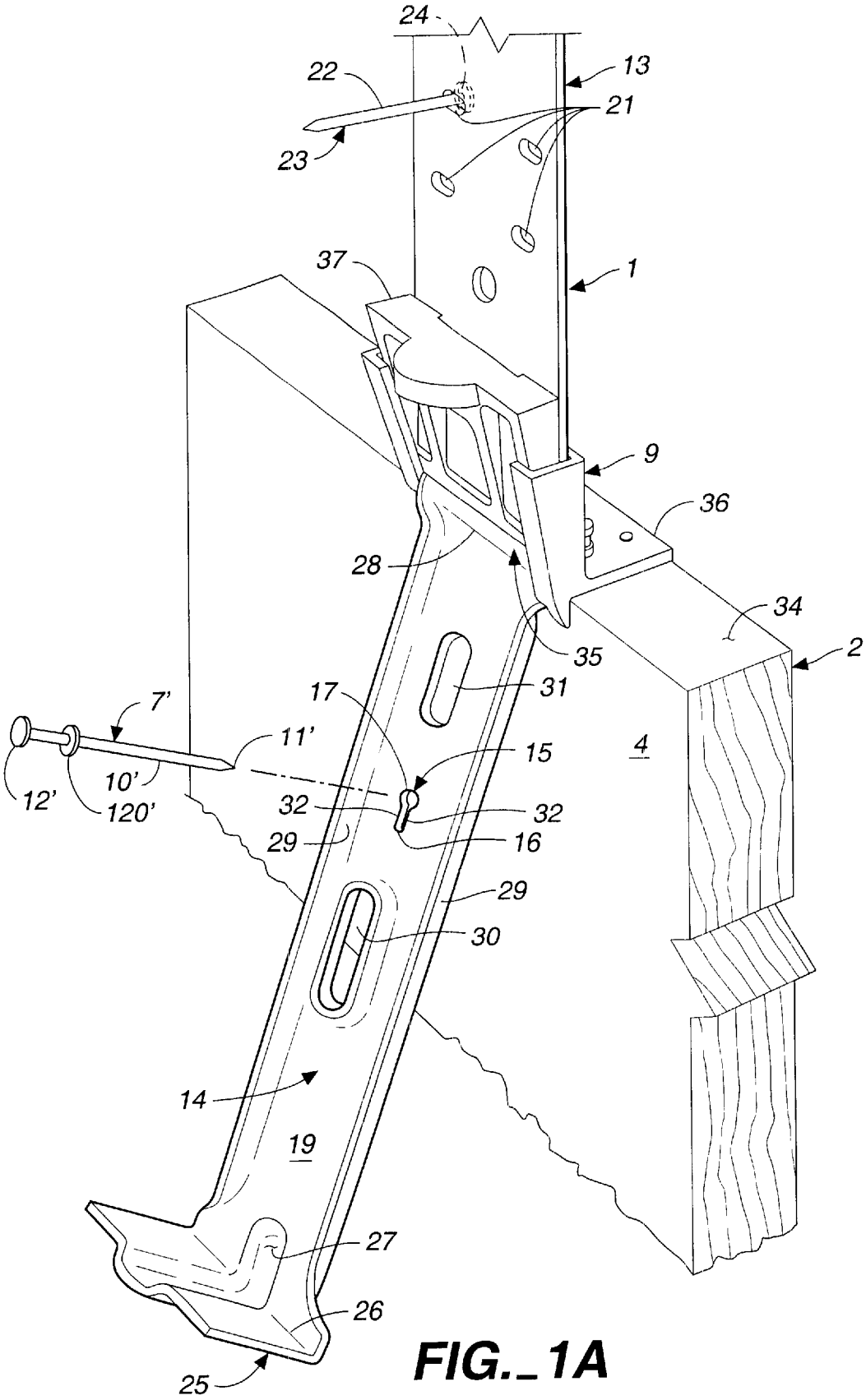
FIG. 1A is a orthogonal view of a strap anchor suspended from a foundation form board. A double-headed nail is shown that is ready to be inserted partially through an opening in the foot section of the strap anchor.
Figure 1B:
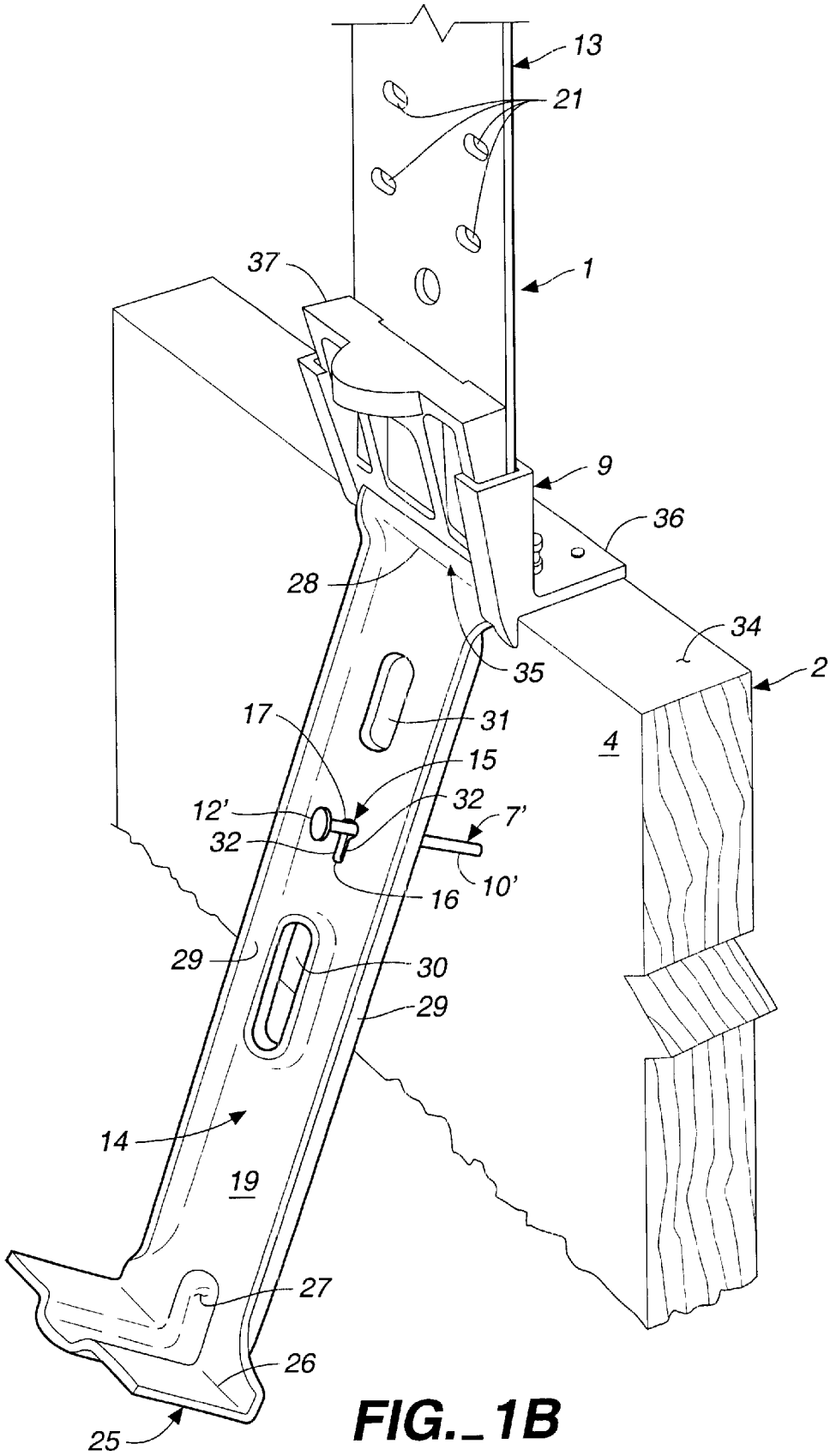
FIG. 1B is a orthogonal view of a strap anchor suspended from a foundation form board. A double-headed nail has been inserted partially through the keyhole opening in the foot section of the connector and hammered partially into the form board. The shank of the nail is shown being received by the enlarged portion of the opening in the foot section.
Figure 1C:
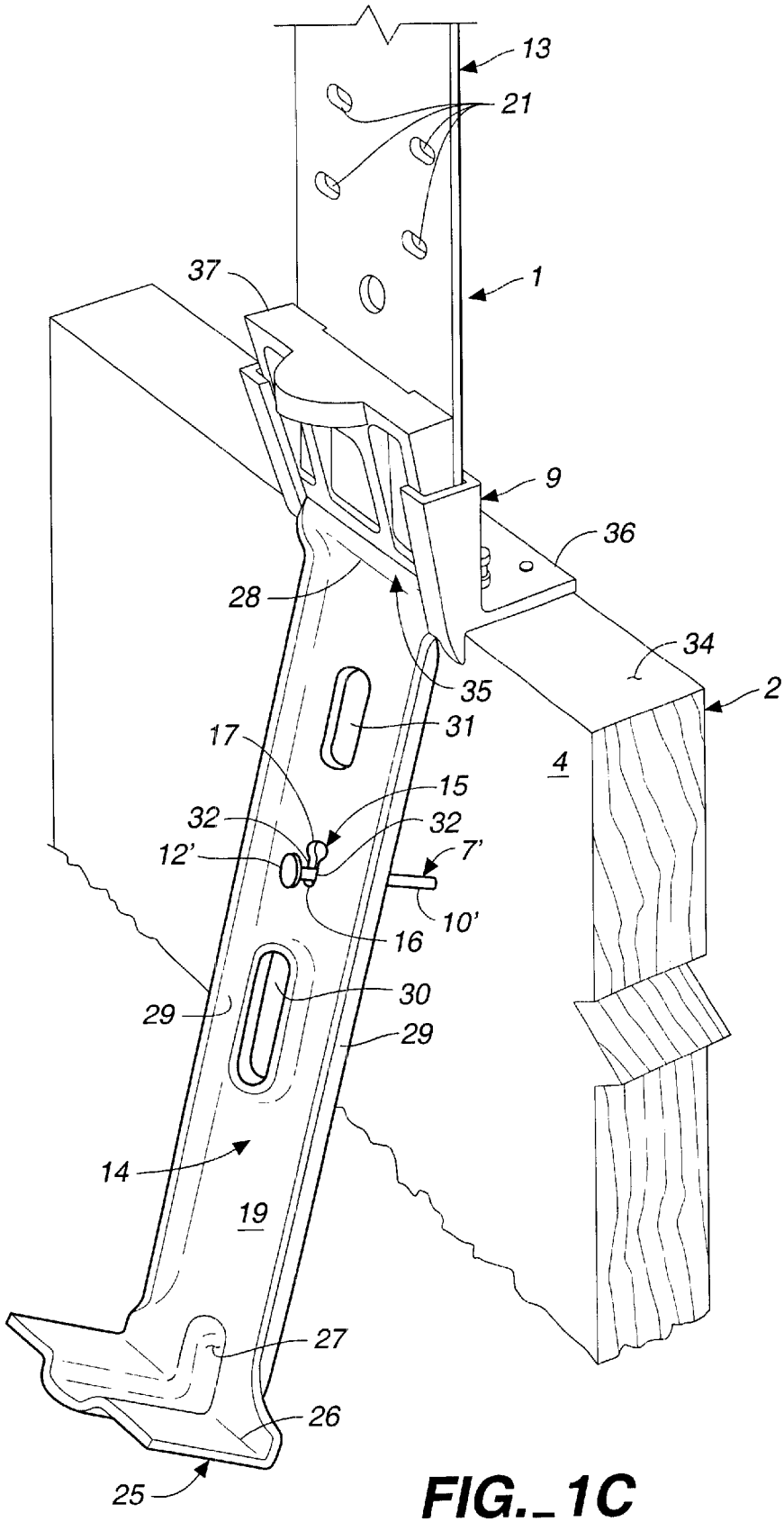
FIG. 1C is similar to FIG. 1B, except that the shank of the nail is shown being received by the constricted portion of the opening in the foot section.
Figure 2:
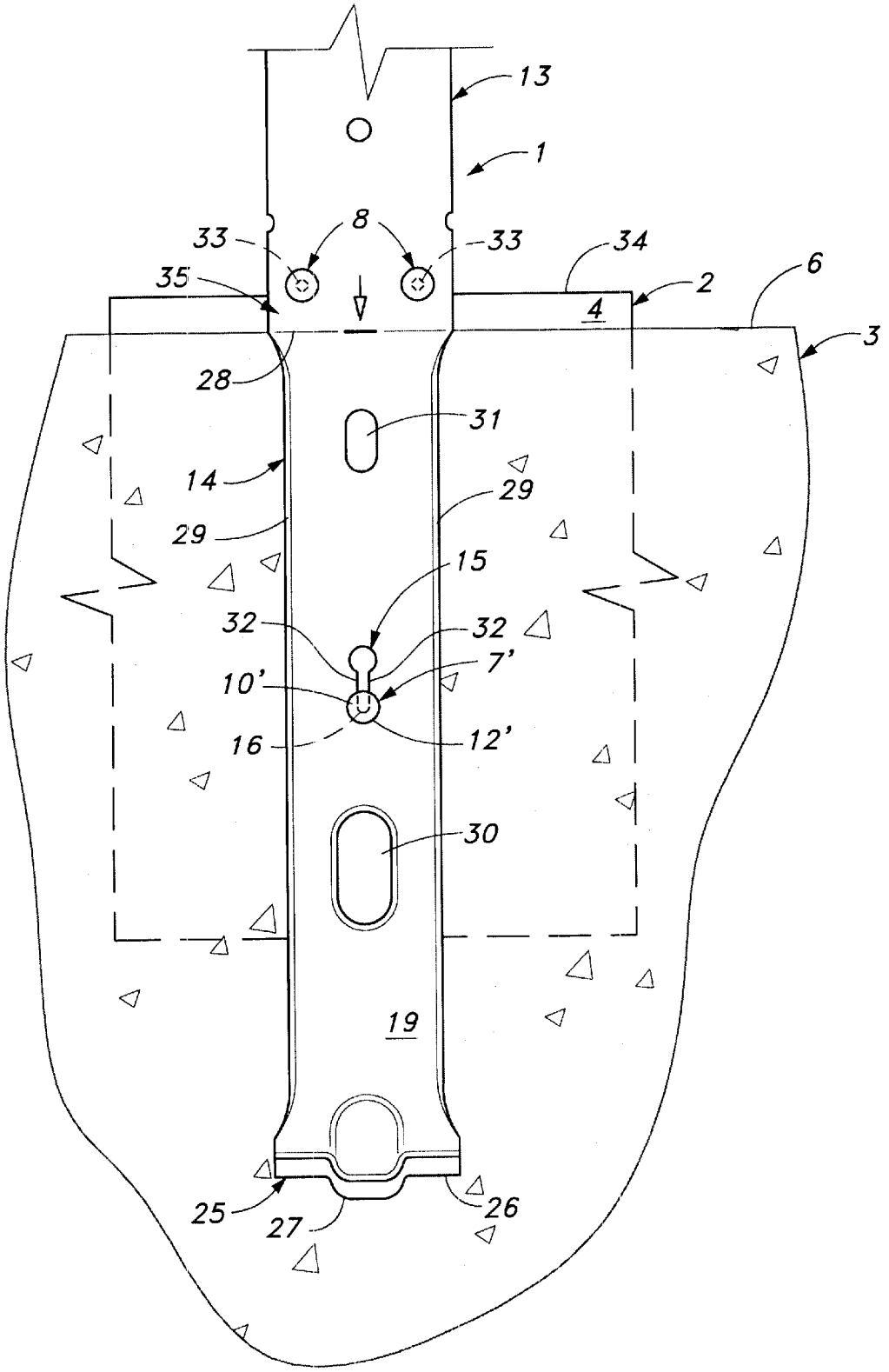
FIG. 2 is a front view of a connector embedded in a foundation. The foot portion of the connector is shown in solid lines although it would be hidden by the foundation. Phantom lines show a portion of a form board disposed on the outer surface of the foundation.

As is best shown in FIGS. 1C and 2, one aspect of the present invention is a connection between a connector 1 and a form board 2. The form board 2 is used to form a cementitious member 3. The form board 2 has an inner surface 4. As is shown in FIG. 3C, the cementitious member 3 has an outer surface 5 that is, at the least, in a partially abutting relationship with the inner surface 4 of the form board 2. The cementitious member 3 also has a top surface 6.

Figure 3A:
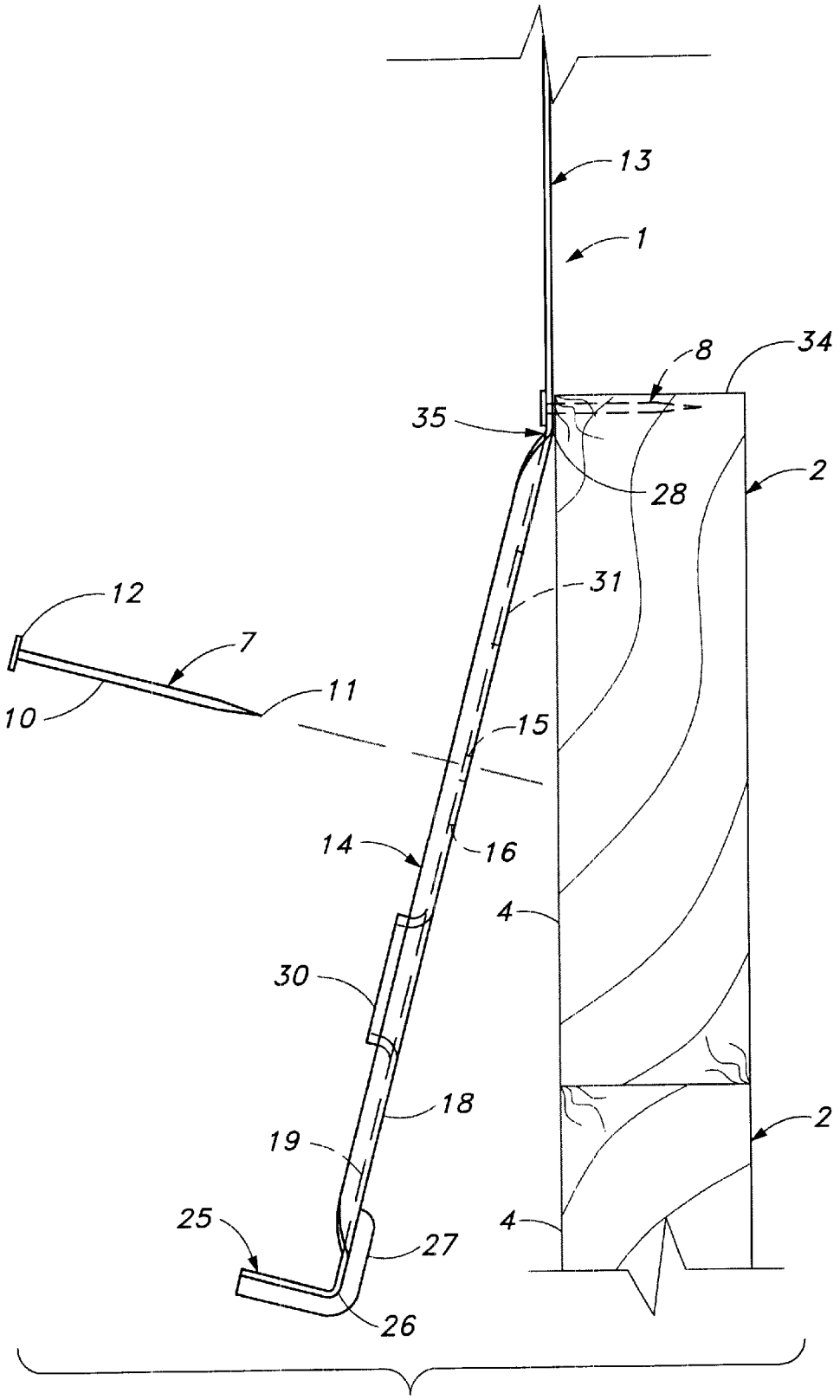
FIG. 3A is a side view of a connector suspended from a foundation form board. A standard nail is shown ready to be partially inserted into a keyhole opening in the foot section of the connector. The keyhole opening is shown in phantom lines.

Referring to FIG. 3A, the connection between the form board 2 and the connector 1 is provided in part by a fastener 7. As is best shown in FIG. 3A, additional fasteners 8 can be used to attach the connector 1 to the form board 2. As is shown in FIG. 1C a special holder 9 can be also be used instead of additional fasteners 8 to attach the connector 1 to the form board 2.

According to the present inventive connection, the fastener 7 is held by the form board 2 and protrudes from the inner surface 4 of the form board 2. Referring to FIG. 3A, the fastener 7 has an elongated relatively narrow shank 10. The shank 10 has a tip 11 that is formed to be embedded in the form board 2. The fastener 7 also has a head 12 at the opposite end of the shank 10 from the tip 11. The head 12 is held way from the inner surface 4 of the form board 2. The head 12 is wider than the relatively narrow shank 10.

As is shown in FIG. 3C, in the present inventive connection, the connector 1 has an attachment section 13 that has at least some portion protruding out of the cementitious member 3. The attachment section 13 is connected to the foot section 14. The foot section 14 is at least partially embedded in the cementitious member 3. As is shown in FIG. 1A, the foot section 14 is formed with at least one opening 15. The opening 15 has a constricted portion 16 communicating with an enlarged portion 17. The enlarged portion 17 is larger than the constricted portion 16. The constricted portion 16 is too narrow to allow the head 12 of the fastener 7 to be received therethrough. In the inventive connection, the foot section 14 is embedded in the cementitious member 3, the tip 11 of the shank 10 is embedded in the form board 2 and the shank 10 of the fastener 7 is received by the constricted portion 16 of the opening 15 in the foot section 14 of the fastener. All of the figures, except FIG. 3A, show the preferred fastener 7' which is a double-headed fastener 7'.

As is shown in FIGS. 1A ,2 and 3A, in the preferred embodiment of the connection the foot section 14 has a first side face 18 and a second side face 19. The first side face 18 is disposed towards the inner surface 4 of the form board 2.

Figure 3B:
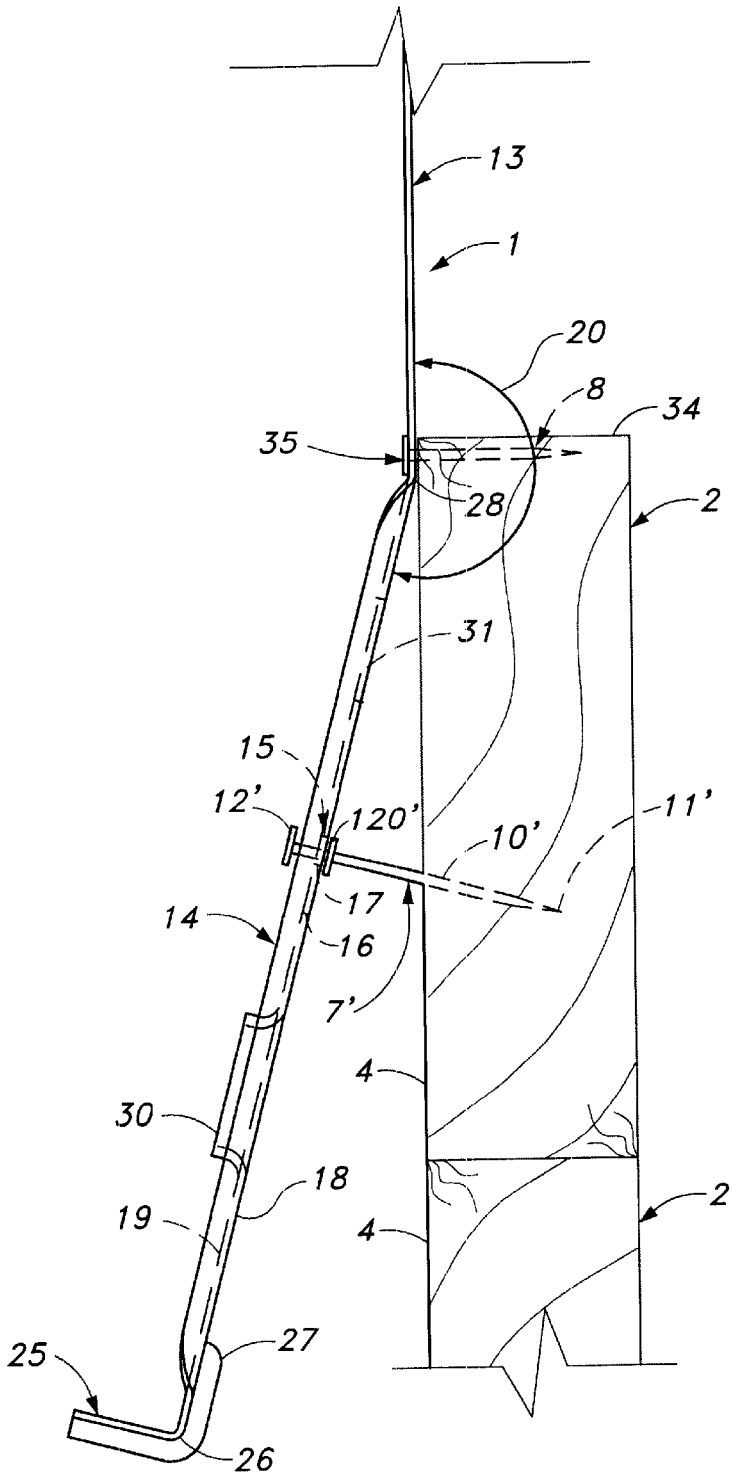
FIG. 3B is a side view of a connector suspended from a foundation form board. A double-headed nail has been partially inserted through the keyhole opening in the foot section of the connector and hammered partially into the form board. The shank of the nail is shown being received by the enlarged portion of the opening in the foot section with the uppermost head of the fastener disposed on the side of the foot section away from the form board. The intermediate head of the fastener is disposed between the foot section of the connector and the form board.
Figure 3C:
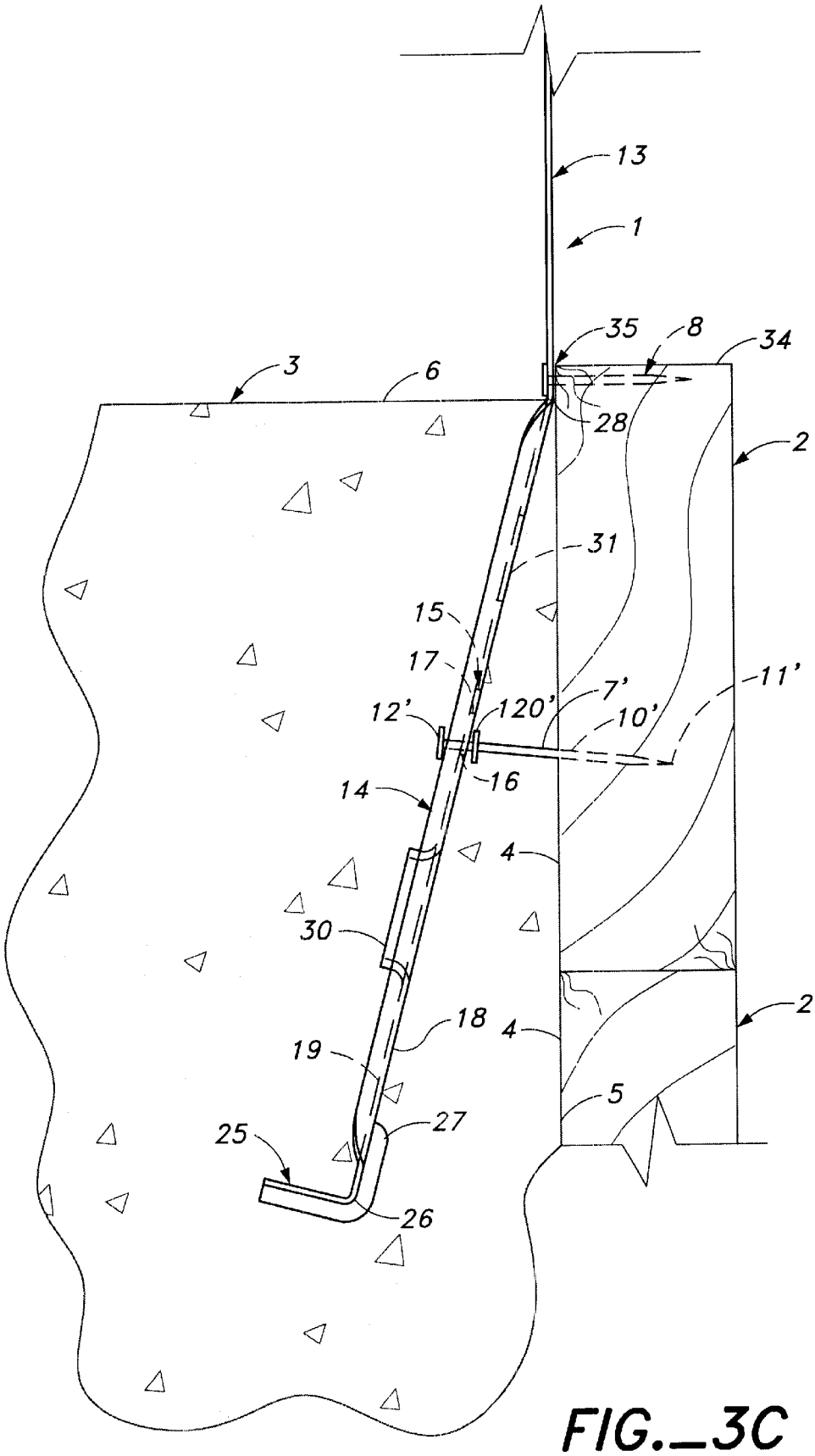
FIG. 3C is similar to FIG. 3B, except that the shank of the nail is shown being received by the constricted portion of the opening in the foot section and the concrete has been poured into the form. The foot section is shown in solid line although it would be hidden by the cement of the foundation.

Also in the preferred form of the connection, the fastener 7' has a second head 120' that lies between the tip 11' of the shank 10' and the head 12' at the end of the shank 10'. This is shown in FIG. 3B. The second head 120' of the fastener 7' is also wider than the relatively narrow shank 10' of the fastener 7'.

Such a fastener 7' with two heads 12' and 120' is typically called a double-headed fastener 7'. Such fasteners 7' are commonly used in building a form for a cementitious member 3. The intermediate head 120' of the double-headed fastener 7' can prevent the nail 7' from being driven completely into a wooden member. This allows the nail 7' to be more easily removed from the member, if it is desirable to disassemble the connection made with the fastener 7'. For example, after a concrete foundation 3 has been poured and set, the form is disassembled by removing the form boards 2 so that only the concrete foundation 3 remains. If any nailed connections are made with double-headed fasteners 7' and the head 12' at the end of the shank 10' is accessible, the nail 7' can be removed rather easily with the pry bar end of a typical framing hammer.

In the preferred form of the connection, as. shown in FIG. 3B, the second head 120' is positioned between the first side face 18 of the foot section 14 and the inner surface 4 of the form board 2, while the head 12' at the end of the shank 10' is disposed above the second side face 19 of the foot section 14 with the foot section 14 between the head 12' at the of the shank 10' and the form board 2.

This arrangement of the end most and intermediate heads 12' and 120' of the fastener 7' and the foot section 14 of the connector 1 prevents the connector 1 from being pushed either toward or away from the form board 2, helping to maintain the alignment of the attachment section 13 of the connector 1.

In the preferred form, the opening 15 in the foot section 14 of the connector 1 is formed with the constricted portion 16 of the opening 15 in the shape of an elongated, narrow slot extending away from the enlarged portion 17 of the opening 15. The narrow slot is closely adjacent or touches the shank 10' of the fastener 7' at at least two points. This is shown in FIG. 2. This helps to insure that the foot section 14 will not move substantially toward or away from the form board 2, because the foot section 14 will encounter one of the heads 12' or 120' of the fastener 7'. Although the preferred form of the constricted portion 16 is a narrow slot, other arrangements of the side or boundary of the constricted portion 16 are possible.

Also in the preferred form, the enlarged portion 17 of the opening 15 in the foot section 14 is circular in shape and has a similar but slightly larger diameter than the intermediate head 120' of the fastener 7'.

In the preferred form of the invention, the connector 1 has a foot section 14 with substantially planar portions. The foot section 14 has a top end and a bottom end, and, as stated above, the foot section 14 is formed with at least one opening 15 therethrough. The opening 15 has a constricted portion 16 and an enlarged portion 17 communicating with the constricted portion 16. The enlarged portion 17 is preferably large enough to receive a shank 10' and the intermediate head 120' of a double-headed fastener 7'. A double-headed fastener 7' has an intermediate head 120' disposed between the tip 11' of the fastener 7' and the head 12' at the opposed end of the fastener 7'. The constricted portion 16 of the opening 15 is preferably formed so that there is at least one point along its length where it is only large enough to closely receive the shank 10 of the fastener 7' on substantially opposed sides of the fastener 7', so that at that point, the opening 15 is too constricted to allow either of the heads of the fastener 7' to pass through the opening 15.

The side of the constricted portion 16 can also closely approach the shank 10' of the fastener 7' at two points on the shank 10' to achieve the desired result of requiring the fastener 7' to be substantially displaced so that the heads 12' and 120' of the fastener '7 can once again pass through the opening 15.

As is shown in FIG. 1A, the preferred connector 1 is also formed with an elongated, substantially planar attachment section 13 integrally connected to the top end of the foot section 14. The attachment section 13 is disposed at a selected angle 20 to the foot section 14 to direct the foot section 14 away from the inner surface 4 of the form board 2. This angle is dependent on such factors as the length of the foot section 14, and the dimensions of the cementitious member 3.

As is shown in FIG. 1A, in the preferred embodiment, the attachment section 13 is formed with a plurality of restricted openings 21. These openings 21 are large enough to receive the shank 22 of standard nailable fasteners 23 but too small to receive the heads 24 of standard nailable fasteners 23 when said fasteners 23 are driven through said openings 21 and into a structural member adjacent the attachment section 13. These fasteners 23 are preferably **16*d*** nails.

As is shown in FIG. 1A, in the preferred embodiment, the connector 1 is formed with a hook section 25 integrally connected to the bottom end of the foot section 14. The hook section 25 is formed to provide mechanical interlock with the cementitious member 3.

As is shown in FIG. 2, in the preferred embodiment of a connector 1 formed in accordance with the present invention, a portion of the hook section 25 is wider than the foot section 14. The hook section 25 is formed with a generally orthogonal bend 26 for creating mechanical interlock with the concrete member 3. Also, in the preferred embodiment, the hook section is formed with a longitudinal embossment 27 that stiffens both the generally orthogonal bend 26 and the hook section 25.

The location of the opening 15 in the foot section 13 that receives the preferred fastener 7' is determined primarily by the length of the fastener 7' and the angle 20 of the main longitudinal bend 28.

The preferred embodiment of the foot section 14 may also be formed with such features as curled side edges 29, a drawn opening 30 and a second opening 31 to improve the connection of the foot section 14 with the cementitious member 3.

The preferred embodiment of the connector 1 is formed from galvanized sheet metal. This permits the connector to be made on standard, automated machinery which is common in the sheet metal connector industry. Furthermore, the preferred form requires no secondary operations after it is formed, such as welding or painting. This further reduces manufacturing costs.

The preferred form of the connector 1 is also formed in accordance with the preferred embodiment of U.S. Pat. No. 5,813,182, granted Sep. 29, 1998, the contents of which are herein incorporated by reference.

As an example, the following is a description of a connector 1 formed in accordance with the preferred form of the present invention that would be used to make a stem-wall-to-wooden stud connection in a typical wood-framed building. The connector 1 is formed from 12 gauge G60 galvanized sheet metal, and is approximately 3" wide. The foot section 14 and the hook section 25, together, reach an embedment depth of approximately 8".

The longitudinal embossment 27 in the hook section 25 is approximately 1" wide by 2¾" long. The displaced portion of the hook section 25 is 1½" long by 3" wide.

The foot section 14 is formed with curled side edges 29, a drawn opening 30, and the opening 15 for receiving the double-headed fastener 7'. The drawn opening 30 is located approximately 4½" from the orthogonal bend 26 in the hook section 25. The drawn opening 30 is formed as an obround slot that is approximately 1⅞" long and ⅞" wide. The curled side edges 29 reduce the width of the foot section 14, making it approximately 2 7/16" wide. The enlarged portion 17 of the opening 15 for receiving the double-headed fastener 7' is located approximately 4⅝" from the main bend 28 in the connector 1. The enlarged portion 17 of the opening 15 is circular and has a diameter of 0.4375". The constricted portion or slot 16 extends approximately 13/16" from the center of the enlarged portion 17 of the opening 15. The slot 16 is approximately 0.1875" wide between its side edges 32.

The attachment section 13 is approximately 21⅝" long and 3" wide. The attachment section 13 is formed with twenty-four obround openings 21 for receiving **16*d* sinkers nails 23 to permanently attach the connector 1 to a stud. Two openings 33 are added to the attachment section 13 near the top end of the foot section 14 to temporarily attach the connector 1 to a form board 2. The connector 1 is formed with embedment indicia to aid the installer in attaching the connector 1 to the form board 2 at the proper height, so that the fasteners 23 enter the stud at the best height. The foot section 14 is displaced from the plane of the attachment section 13 at a selected angle 20** of 206 degrees.

Use and the formation of a connection according to the present invention is illustrated in FIG. 1A.

First, a form is created that is to be filled with an uncured cementitious member 3. The form consists of form boards 2, and at least some of the form boards 2 having inner surfaces 4 that will define the outer surfaces 5 of the foundation when the cementitious member 3 has cured. Further, at least some of the form boards 2 have a top surface 34 that will be equal to or above the top 5 of the cementitious member 3 when it has cured.

Second, a fastener 7 is selected. According to the present invention, the fastener 7 has a narrow shank 10 with a head 12 attached thereto at one end, the head 12 of the fastener 7 being wider than the shank 10, and the shank 10 having a tip 11 at an opposite end from head 12 of said fastener 7.

Third, a connector 1 is selected. The connector 1 has an attachment section 13 and a foot section 14. The attachment section 13 has a bottom end. The foot section 14 is formed with at least one opening 15 therethrough. In the preferred embodiment, the opening 15 has a constricted portion 16 communicating with an enlarged portion 17. The enlarged portion 17 is larger than the constricted portion 16 of the opening. The constricted portion 16 is too narrow to allow the head 12 of the fastener 7 to be received therethrough. Preferably, the constricted portion 16 is also shaped so that two side edges 32 of the constricted opening closely approach the shank 10 of the fastener 7 at two different points.

The foot section 14 also has a top end and a bottom end, and the attachment section 13 and the foot section 14 are connected together at a transition area 35. The transition area 35 comprises the bottom end of the attachment section 13 and the top end of the foot section 14.

The connector 1 is then suspended in the form such that the transition area 35 is substantially adjacent to the inner surface 4 of one of the form boards 2. Furthermore, the connector 1 is suspended in such a manner that at least a portion of the attachment section 13 of the connector 1 protrudes out of the form. This is preferably accomplished with the special holder 9. This holder 9 consists of a base 36 and a wedge 37 that fits into the base 36 and pinches the attachment section 13 of the connector against the base 36. The base 36 is preferably, removably attached to the form board 2 with double-headed fasteners 7'.

Suspended in this manner, at least a portion of the attachment section 13 of the connector 1 will protrude out of the cementitious member 3 after it has cured, and preferably, substantially all of the attachment section 13 will protrude out of the cementitious member 3 after it has cured. Meanwhile, the bottom end of the foot section 14 of the connector 1 is disposed within the form and is removed from the inner surface 4 of the form board 2 to which the transition section 35 is substantially adjacent.

Next, the shank 10 of the fastener 7 is inserted through the enlarged portion 17 of the opening 15 in the foot section 14 of the connector 1, and the tip 11 of the fastener 7 is driven into the same inner surface 4 of the form board 2, such that the fastener 7 is supported by the form board 2, and the head 12 of the fastener 7 is disposed adjacent to the foot section 14 of the connector 1.

Then, the shank 10 of the fastener 7 is slid into the constricted portion 16 of the opening 15, which is easily accomplished by tapping on the shank 10 of the fastener 7 in the direction of the constricted portion 16 of the opening 15 with a hammer.

Finally, the form is filled with the wet cementitious member 3 and the cementitious member 3 is allowed to cure.

According to the preferred method of making the connection, the foot section 14 has a first side face 18 and a second side face 19. The first side face 18 is disposed towards the inner surface 4 of the form board 2, when the connector 1 is suspended in the form. Furthermore, the preferred fastener 7' to be used in the preferred method has a second head 120' that lies between the tip 11' of the shank 10' and the head 12' at the end of the shank 10'. This second head 120' is also wider than the relatively narrow shank 10'.

In the preferred method of making the connection, the fastener 7' is driven into the form board 2 at an angle so that the heads of the nail lie parallel with the general orientation of the preferred foot section 14 of the connector 1. However, the inventor has found that the angle of the fastener 7' is not critical to the performance of the connection.

In the preferred method of making the connection, after the tip 11' of the fastener 7' is driven into the inner surface 4 of the form board 2, the second head 120' is disposed between the first side face 18 of the foot section 14 and the inner surface 4 of the form board 2, and the head 12' at the end of the shank 10' is disposed above the second side face 19 of the foot section 14 with the foot section 14 between the head 12' at the end of the shank 10' and the form board 2.

In the preferred method of making the connection, the constricted portion 16 of the opening 15 is formed as an elongated, narrow slot extending away from the enlarged portion 17 of the opening 15. The narrow slot 16 can extend away from the attachment section 13 of the connector 1 or towards the attachment section 13 of the connector 1. If the narrow slot 16 extends away from the attachment section 13, the fastener 7' slides into the constricted portion 15 by pulling it down or tapping the shank 10' with a hammer from above. This motion is essentially perpendicular to the shank 10' of the fastener 7'.

I claim:

1. A connection, comprising:

a. a form board, comprising an inner surface;

b. a cementitious member, comprising an outer surface that is in abutting relationship with said inner surface of said form board, said cementitious member also comprising a top surface;

c. a fastener held by said form board and protruding from said inner surface of said form board, said fastener comprising an elongated, relatively narrow shank, said shank having a tip that is embedded in said form board, said fastener also comprising a head at an opposite end of said shank from said tip, said head being held away from said inner surface of said form board and is attached to said shank, said head being wider than said relatively narrow shank;

d. a connector, comprising an attachment section that has at least some portion protruding out of said cementitious member and is attached to a foot section, said foot section being at least partially embedded in said cementitious member; and e. wherein said foot section is formed with at least one opening therethrough, said opening having a constricted portion communicating with an enlarged portion, and said enlarged portion is larger than said constricted portion, and said constricted portion has a side and is too narrow to allow said head of said fastener to be received therethrough, and said constricted portion receives said shank of said fastener therethrough with said side of said constricted portion of said opening closely approaching said shank of said fastener at two different points on said shank.

2. The connection of claim 1, wherein:

a. said foot section further comprises a first side face and a second side face with said first side face being disposed towards said inner surface of said form board;

b. said fastener further comprises a second head that lies between said tip of said shank and said head at said end of said shank, said second head also being wider than said relatively narrow shank;

c. said second head is disposed between said first side face of said foot section and said inner surface of said form board, and said head at said end of said shank is disposed such that said foot section lies between said head at said end of said shank and said form board; and d. said enlarged portion of said opening in said foot section is large enough to receive therethrough one of said heads of said fastener.

3. The connection of claim 2, wherein:

said constricted portion of said opening is formed as an elongated, narrow slot extending away from said enlarged portion of said opening.

4. The connection of claim 3, wherein:

said enlarged portion of said opening is substantially circular in shape and has a similar but slightly larger diameter than one of said heads of said fastener.

5. The connection of claim 1, wherein:

said constricted portion of said opening is formed as an elongated, narrow slot extending away from said enlarged portion of said opening.

6. A connector for securing a first structural member to a cementitious second structural member, said connector comprising:

a. a substantially planar foot section having a top end and a bottom end, a first fastener having a shank and a head, wherein said foot section is formed with at least one opening therethrough adapted to receive said fastener having a shank and a head, said opening having a constricted portion and an enlarged portion communicating with said constricted portion, and wherein said enlarged portion is larger than said constricted portion, and wherein said constricted portion has a length and a side, and said constricted portion is formed such that at a first point along its length, said constricted portion is shaped such that said side of said constricted portion of said opening is formed to closely approach said shank of said fastener at two different points on said shank such that it can closely receive said shank of said fastener, such that at said first point, said opening is too constricted to allow a head of said fastener to pass through said opening;

b. an elongated, substantially planar attachment section integrally connected to said top end of said foot section and disposed at a selected angle to said foot section, said attachment section being formed with a plurality of restricted openings that are large enough to receive shanks of standard nailable fasteners but are too small to receive heads of standard nailable fasteners; and c. a hook section integrally connected to said bottom end of said foot section, said hook section being formed to provide mechanical interlock with said cementitious member.

7. The connector of claim 6, wherein:

said enlarged opening is large enough to receive said shank and said head of said fastener.

8. The connector of claim 7, wherein:

said constricted portion of said opening is formed as a narrow slot extending away from said enlarged portion of said opening.

9. The connector of claim 8, wherein:

said enlarged portion of said opening is substantially circular in shape and has a similar but slightly larger diameter than said head of said fastener.

10. The connector of claim 6, wherein:

said constricted portion of said opening is formed as a narrow slot extending away from said enlarged portion of said opening.

11. A method of setting a connector in a poured cementitious foundation, said connector being formed to attach to a structural framing member that is set above said foundation after it has cured, said method comprising:

a. creating a form that is to be filled with an uncured cementitious member, said form having form boards, at least some of said form boards having inner surfaces that will define outer surfaces of said foundation when said cementitious member has cured, and at least some of said form boards having top surfaces that will be equal to or above the level of said cementitious member when it has cured;

b. selecting a fastener, said fastener having a narrow shank with a head attached thereto at one end, said head of said fastener being wider than said shank, and said shank having a tip at an opposite end from said head of said fastener;

c. selecting a connector, said connector having an attachment section and a foot section, said attachment section having a bottom end, said foot section being formed with at least one opening therethrough, said foot section also having a top end and a bottom end, and wherein said attachment section and said foot section are connected together at a transition area, said transition area comprising said bottom end of said attachment section and said top end of said foot section;

d. suspending said connector in said form such that said transition area is substantially adjacent said inner surface of one of said form boards with at least a portion of said attachment section of said connector protruding out of said form such that at least a portion of said attachment section of said connector would protrude out of said cementitious member after it has cured, and said bottom end of said foot section of said connector is disposed within said form and is removed from said inner surface of said one of said form boards to which said transition section is substantially adjacent;

e. inserting said shank of said fastener in a direction parallel to said shank and toward said tip through said opening in said foot section of said connector;

f. driving said tip of said fastener into said same inner surface of said one of said form boards or an inner surface of a different form board that is aligned with said inner surface which lies adjacent said transition section, such that said fastener is supported by said form, and said head of said fastener is disposed adjacent said foot section of said connector;

g. sliding said shank of said fastener in said opening substantially perpendicular to said shank of said fastener; and h. filling said form with said uncured cementitious member.

12. The method of claim 11, wherein:

a. said foot section further comprises a first side face and a second side face with said first side face being disposed towards said inner surface of said one of said form boards when said connector is suspended in said form; and b. said fastener further comprises a second head that lies between said tip of said shank and said head at said end of said shank, said second head also being wider than said relatively narrow shank; and c. after said tip of said fastener is driven into said inner surface of one of said form boards, said second head is disposed between said first side face of said foot section and said inner surface of said one of said form boards, and said head at said end of said shank is disposed such that said foot section is disposed between said head at said end of said shank and said one of said form boards.

13. The method of claim 11, wherein:

said opening has a constricted portion communicating with an enlarged portion, and said enlarged portion is larger than said constricted portion, and wherein said constricted portion has a length and a side, and said constricted portion is formed such that at a point along its length, said constricted portion is shaped such that said side of said constricted portion of said opening closely approaches said shank of said fastener at two different points to closely receive said shank of said fastener, such that at said same point, said opening is too constricted to allow said head of said fastener to pass through said opening.

14. The method of claim 13, wherein:

said constricted portion of said opening is formed as an elongated, narrow slot extending away from said enlarged portion of said opening.

15. The method of claim 14, wherein:

said enlarged portion of said opening is substantially circular in shape and has a similar but slightly larger diameter than one of said heads of said fastener.

16. A connection, comprising:

a. a form board, comprising an inner surface;

b. a cementitious member, comprising an outer surface that is in abutting relationship with said inner surface of said form board, and a top surface;

c. a fastener held by said form board and protruding from said inner surface of said form board, said fastener comprising an elongated, relatively narrow shank, said shank having a tip that is embedded in said form board, said fastener also comprising a head at an opposite end of said shank from said tip, said head being held away from said inner surface of said form board and is attached to said shank, said head being wider than said relatively narrow shank, and said fastener further comprising a second head that lies between said tip of said shank and said head at said end of said shank, said second head also being wider than said relatively narrow shank;

d. a connector, comprising an attachment section that has at least some portion protruding out of said cementitious member and is attached to a foot section, said foot section being at least partially embedded in said cementitious member; and e. wherein said foot section is formed with at least one opening therethrough, said opening receiving said shank of said fastener therethrough.

17. The connection of claim 16, wherein:

a. said foot section further comprises a first side face and a second side face with said first side face being disposed towards said inner surface of said form board;

b. said second head of said fastener is disposed between said first side face of said foot section and said inner surface of said form board, and said head at said end of said shank is disposed such that said second side face is disposed between said head at said end of said shank and said form board; and c. said opening in said foot section is large enough to receive therethrough one of said heads of said fastener.

* * * * *